US009909525B2

(12) United States Patent
Jang

(10) Patent No.: US 9,909,525 B2
(45) Date of Patent: Mar. 6, 2018

(54) WATER JACKET FOR ENGINE

(71) Applicants: Hyundai Motor Company, Seoul (KR); Kia Motors Corporation, Seoul (KR)

(72) Inventor: Sung Kweon Jang, Seongnam-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 2 days.

(21) Appl. No.: 15/190,597

(22) Filed: Jun. 23, 2016

(65) Prior Publication Data

US 2017/0167431 A1 Jun. 15, 2017

(30) Foreign Application Priority Data

Dec. 14, 2015 (KR) ..... 10-2015-0178484

(51) Int. Cl.

| | |
|---|---|
| ***F02F 1/14*** | (2006.01) |
| ***F02F 1/36*** | (2006.01) |
| ***F01P 3/02*** | (2006.01) |

(52) U.S. Cl.

CPC ..... *F02F 1/36* (2013.01); *F01P 3/02* (2013.01); *F02F 1/14* (2013.01); *F01P 2003/021* (2013.01); *F01P 2003/024* (2013.01)

(58) Field of Classification Search

CPC ..... F02F 1/36; F02F 1/14; F01P 3/02; F01P 2003/024; F01P 2003/021

See application file for complete search history.

(56) References Cited

U.S. PATENT DOCUMENTS

2002/0000210 A1* 1/2002 Shinpo ..... F01P 3/02 123/41.74

FOREIGN PATENT DOCUMENTS

| | | | |
|---|---|---|---|
| JP | 2007-56770 | A | 3/2007 |
| JP | 2007-56771 | A | 3/2007 |
| JP | 2010-203245 | A | 9/2010 |
| JP | 2011-106389 | A | 6/2011 |
| JP | 2015-4333 | A | 1/2015 |

* cited by examiner

*Primary Examiner* — Hung Q Nguyen

(74) *Attorney, Agent, or Firm* — Morgan, Lewis & Bockius LLP

(57) ABSTRACT

A water jacket apparatus for an engine may include a block water jacket provided in the cylinder block, interposing the combustion chamber therebetween, a head water jacket provided in the cylinder head corresponding to the combustion chamber, and an insert member portioning the block water jacket into an upper block water jacket and a lower block water jacket by being inserted into an upper portion of the block water jacket, and enabling the upper block water jacket to be interworked with the head water jacket.

5 Claims, 4 Drawing Sheets

WATER JACKET FOR ENGINE

CROSS-REFERENCE TO RELATED APPLICATION

The present application claims priority to and the benefit of Korean Patent Application No. 10-2015-0178484 filed on Dec. 14, 2015, the entire contents of which is incorporated herein for all purposes by this reference.

BACKGROUND OF THE INVENTION

Field of the Invention

The present invention relates to a water jacket for an engine. More particularly, the present invention relates to a water jacket for an engine, which can improve entire cooling efficiency by controlling a flow of a coolant.

Description of Related Art

In general, a part of heat generated from a combustion chamber of an engine is absorbed by a cylinder heat, a cylinder block, intake/exhaust valves, and a piston.

When a temperature is excessively increased, the constituent parts may undergo thermal deformation or an oil film in an inner wall of the cylinder may be damaged such that lubrication failure may be caused, thereby causing and a thermal defect.

Such a thermal defect may cause abnormal combustion such as combustion failure, knocking, and the like, thereby causing serious damage such as melting of the piston. In addition, thermal efficiency and output may be deteriorated. On the contrary, excessive cooling of the engine may cause deterioration of an output and fuel consumption efficiency and low-temperature abrasion of the cylinder, and accordingly, a temperature of the coolant should be appropriately controlled.

In such an aspect, a water jacket is provided in the inside of a cylinder block and a cylinder head of a conventional engine, and a coolant circulating the water jacket cools metal surfaces such as the periphery of a spark plug that corresponds to the combustion chamber, an exhaust port, and the periphery of a valve sheet.

However, in the water jacket applied to the cylinder block and the cylinder head of the conventional engine, the coolant sequentially introduced into each cylinder is respectively circulated such that the cylinder block and the cylinder head corresponding to the combustion chamber cannot be effectively cooled, and accordingly, the entire engine canoe be effectively cooled.

In addition, sine the engine cannot be effectively cooled, durability of the engine is deteriorated, and thus an additional cooling jet needs to be installed to prevent the deterioration of the durability or performance of the water pump needs to be improved, thereby causing increase of investment cost.

Further, the cylinder head needs to be cooled down to a temperature that is relatively lower than that of the cylinder block, but it is difficult to respectively control temperatures of the coolant.

In addition, when a temperature of the coolant is low, viscosity of oil is increased so that a frictional force is increased, which causes increase of fuel consumption, thereby causing deterioration of fuel consumption efficiency, and when a temperature of the coolant of the engine is excessively high, knocking is generated, which causes control of ignition timing, thereby causing deterioration of engine performed.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a water jacket for an engine, which can cool the engine with a cross-flow type coolant such that a coolant flows to an upper portion of a cylinder block and a cylinder head and realize individual cooling by enabling a coolant to individually flow to a lower portion of the cylinder block, to thereby optimize cooling effect and improve fuel consumption efficiency.

A water jacket for an engine including a plurality of combustion chambers formed thereinside, a cylinder block where a piston is reciprocally movably installed so as to compress or expand the combustion chamber, and a cylinder head installed in an upper portion of the cylinder block according to an aspect of the present invention may include a block water jacket provided in the cylinder block, interposing the combustion chamber therebetween, a head water jacket provided in the cylinder head corresponding to the combustion chamber, and an insert member portioning the block water jacket into an upper block water jacket and a lower block water jacket by being inserted into an upper portion of the block water jacket, and enabling the upper block water jacket to be interworked with the head water jacket.

The insert member may be installed toward the combustion chamber from an upper portion of the block water jacket.

The upper block water jacket may be disposed toward an outer side of the cylinder block in the inside of the cylinder block.

The lower block water jacket may be disposed toward the combustion chamber in the inside of the cylinder block so as to be stepped with the upper block water jacket.

A coolant introduced into the upper block water jacket may flow as a cross-flow type so as to pass through the head water jacket while moving along a length direction of the cylinder block.

A coolant introduced into the lower block water may flow along a length direction of the cylinder block.

The insert member may be installed toward an outer side of the cylinder block at an upper portion of the block water jacket.

The upper block water jacket may be disposed toward the combustion chamber in the inside of the cylinder block.

The lower block water jacket may be disposed toward an outer side of the cylinder block so as to be stepped with the upper block water jacket.

The water jacket for the engine according to the exemplary embodiment of the present invention can cool the engine with a cross-flow type coolant such that a coolant flows to an upper portion of a cylinder block and a cylinder head and realize individual cooling by enabling a coolant to individually flow to a lower portion of the cylinder block, to thereby optimize cooling effect and improve durability of the engine.

In addition, the water jacket for the engine cools the cylinder head with a temperature that is lower than that of the cylinder block so that generation of knocking can be prevented, thereby minimizing the amount of blow by gas, and ignition timing control can be minimized, thereby improving engine performance.

In addition, the water jacket for the engine cools the cylinder block with a temperature that is relatively higher than that of the cylinder head so that a temperature of engine oil is increased, thereby reducing viscosity of the engine oil.

Further, since the viscosity of the engine oil is decreased, a frictional force from reciprocal movement of the piston can be reduced, thereby preventing unnecessary fuel consumption and improving entire fuel consumption efficiency.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
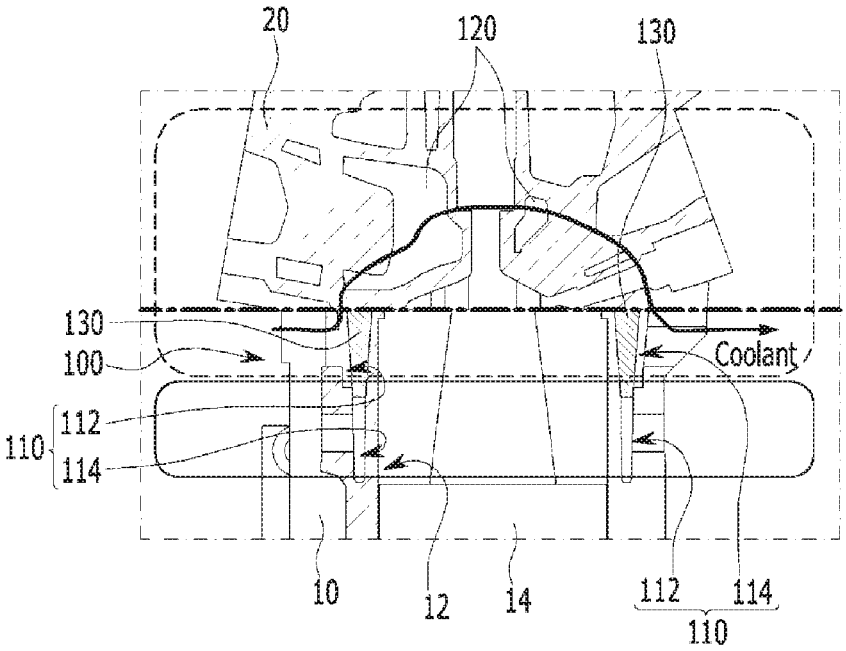
FIG. 1 is a schematic diagram of a water jacket for an engine according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An exemplary embodiment of the present invention will hereinafter be described in detail with reference to the accompanying drawings.

Therefore, configurations illustrated in the embodiments and the drawings described in the present specification are only the most exemplary embodiment of the present invention and do not represent all of the technical spirit of the present invention, and thus it is to be understood that various modified examples, which may replace the configurations, are possible when filing the present application.

The drawings and description are to be regarded as illustrative in nature and not restrictive, and like reference numerals designate like elements throughout the specification.

However, the size and thickness of each component illustrated in the drawings are arbitrarily shown for ease of description and the present invention is not limited thereto, and the thicknesses of portions and regions are exaggerated for clarity.

In addition, unless explicitly described to the contrary, the word "comprise" and variations such as "comprises" or "comprising", will be understood to imply the inclusion of stated elements but not the exclusion of any other elements.

In addition, terms such as "unit", "means", "part", "member", etc., which are described in the specification, mean a unit of a comprehensive configuration that performs at least one function or operation.

FIG. 1 is a schematic diagram of a water jacket for an engine according to an exemplary embodiment of the present invention.

Referring to FIG. 1, a water jacket 100 for an engine according to an exemplary embodiment of the present invention is applied to an engine that includes a plurality of combustion chambers 12 formed therein, a cylinder block 10 where a piston 14 is reciprocally movably installed so as to compress or expand the combustion chamber 12, and a cylinder head 20 provided in an upper portion of the cylinder block 10.

Such a water jacket 100 includes a block water jacket 110, a head water jacket 120, and an insert member 130.

The block water jacket 110 is provided in the cylinder block 10, interposing the combustion chambers 12 therebetween. Such a block water jacket 110 may be provided along a length direction of the cylinder block 10 at a location that is separated by a predetermined distance from the combustion chambers 12 formed in the cylinder block 10.

The head water jacket 120 is provided in the cylinder head 20 corresponding to the combustion chamber 12.

In addition, the insert member 130 is inserted to an upper portion of the block water jacket 110 to partition the block water jacket 110 into an upper block water jacket 112 and a lower block water jacket 114. Further, the insert member 130 enables the upper block water jacket 112 and the head water jacket 120 to be interworked with each other.

Here, the insert member 130 may be installed toward to the combustion chamber 12 at the upper portion of the block water jacket 112.

That is, the upper block water jacket 112 is disposed toward an outer side of the cylinder block 10 in the inside of the cylinder block 10.

The lower block water jacket 114 may be disposed toward the combustion chamber 12 in the inside of the cylinder block 10 so as to be stepped by the upper block water jacket 112 and the insert member 130.

Accordingly, a coolant introduced into the upper block water jacket 112 can flow as a cross-flow type so as to pass through the head water jacket 120 while moving along the length direction of the cylinder block 10.

The cross-flow of the coolant can effectively cool down the upper portion of the combustion chamber 12 and the cylinder head 20 of which temperatures are relatively higher than the cylinder block 10 since a high-temperature exhaust gas is discharged.

In addition, the coolant introduced into the lower block water jacket 114 may flow along the length direction of the cylinder block 10.

When the cylinder block 10 is cooled down by the water jacket 100 for the engine having the above-stated configuration, the combustion chamber 12 is vertically separated by using the upper block water jacket 112 and the lower water jacket 114 with reference to the height direction of the combustion chamber 12 and the coolant flows respectively to the separated portions.

In addition, when the cylinder head 20 is cooled down, the coolant flows as a cross flow type to the head water jacket 120 from the upper block water jacket 112.

Figure 2:
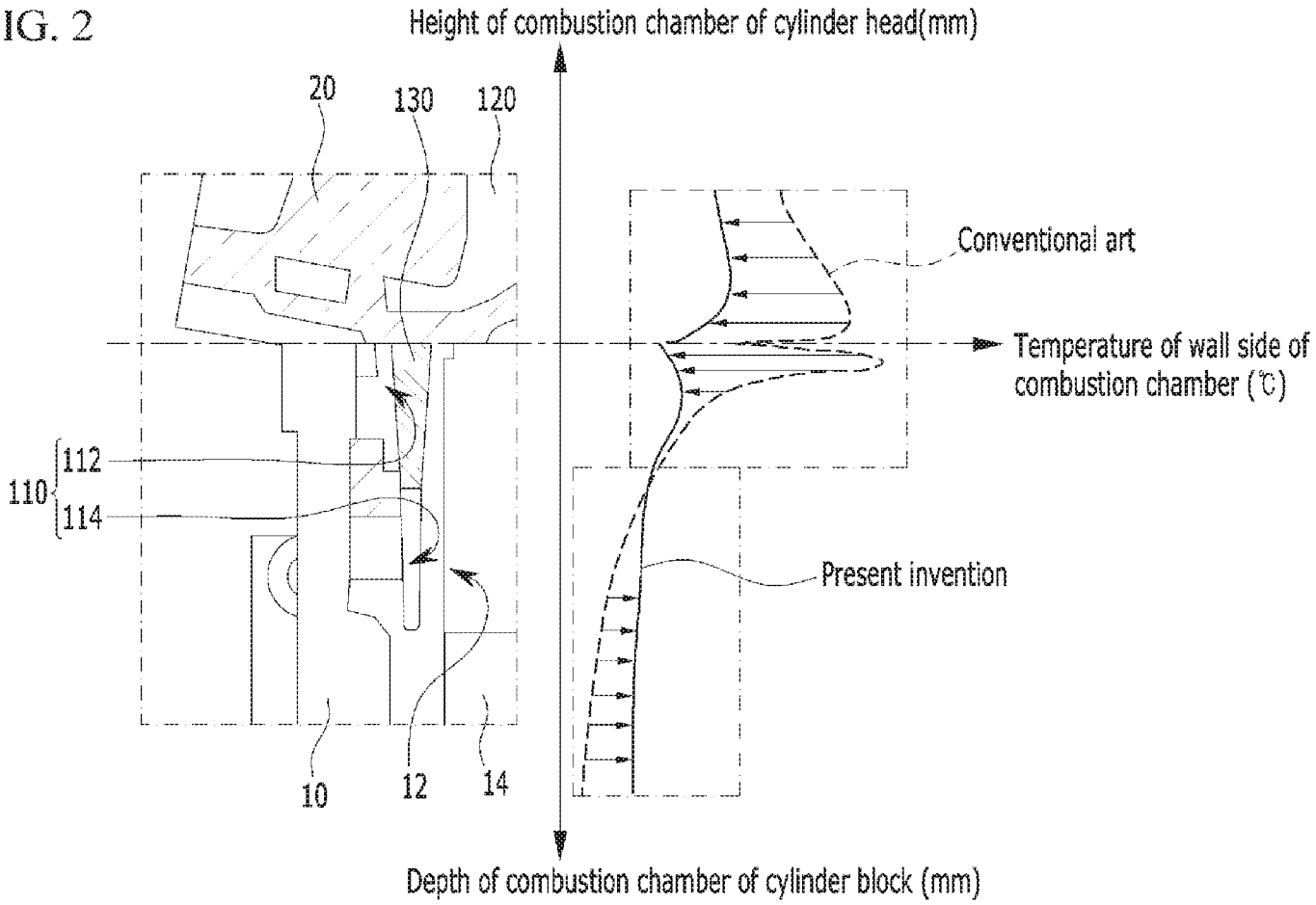
FIG. 2 illustrates temperature distribution according to the depth of a combustion chamber of a cylinder block and the height of a combustion chamber of a cylinder head in an engine where the water jacket according to the exemplary embodiment of the present invention is applied, compared to a conventional art.

FIG. 2 illustrates temperature distribution according to the depth of the combustion chamber of the cylinder block and the height of the combustion chamber of the cylinder head in an engine where the water jacket 100 according, to the exemplary embodiment of the present invention is applied, compared to a conventional art.

Referring to FIG. 2, the upper portion of the combustion chamber 12 and the cylinder head 20 having relatively higher temperatures with reference to a surface where the cylinder block 10 and the cylinder head 20 are combined are cooled using the coolant introduced into the upper block water jacket 112 and the coolant introduced as the cross-flow type to the head water jacket 120 from the upper block water jacket 112 to the head water jacket 120.

The lower portion of the combustion chamber 12, of which the temperature is relatively lower than the upper portion of the combustion chamber 12 is cooled using the coolant flowing through the lower block water jacket 114 which has been partitioned from the upper block water jacket 112 by the insert member 130.

Accordingly, the block water jacket 110 is separated into the upper block water jacket 112 and the lower block water jacket 114 from the cylinder block 10 such that the coolant can individually flow according to the height of the combustion chamber 12.

In addition, the coolant introduced from the upper block water jacket 112 flows as the cross-flow type in the heat water jacket 120 in the cylinder head 20.

That is, the water jacket 100 separately cools the upper portion and the lower portion of the combustion chamber 12 in the cylinder block 10 and cools the cylinder head 20 with the cross-flow type coolant together with the upper portion of the combustion chamber 12 such that the engine can be more effectively cooled.

Temperature distribution of the side wall of the combustion chamber 12 according to the depth of the combustion chamber 12 in the cylinder block 10 and the cylinder head 20 when the coolant flows into the water jacket 100 according to the exemplary embodiment of the present invention as shown in FIG. 2 will now be described.

First, a temperature of the upper portion of the wall side of the combustion chamber 10 and a temperature of the cylinder head 20, which are relatively high with reference to the surface where the cylinder block 10 and the cylinder head 20 are combined are lowered compared to a conventional art.

On the contrary, when the piston 14 moves forward and backward, a temperature of a lower portion of the side wall of the combustion chamber 12, which is relatively low, is increased compared to the conventional art.

That is, the upper portion of the combustion chamber 12 and the cylinder head 20 having high-temperatures are effectively cooled by using the upper water jacket 112 and the head water jacket 120 such that the temperature of the side wall of the combustion chamber 12 can be decreased compared to the conventional art, thereby preventing generation of knocking and minimizing ignition timing control.

On the contrary, a temperature of the lower portion of the side wall of the combustion chamber 12, which is a relatively low temperature compared to the upper portion of the side wall of the combustion chamber 12 and the cylinder head 20, is increased such that viscosity can be decreased by increasing the temperature of engine oil. When the viscosity of the engine oil is decreased, a frictional force of the piston 14 reciprocally moving in the combustion chamber 12 can be minimized, thereby reducing fuel consumption.

Figure 3:
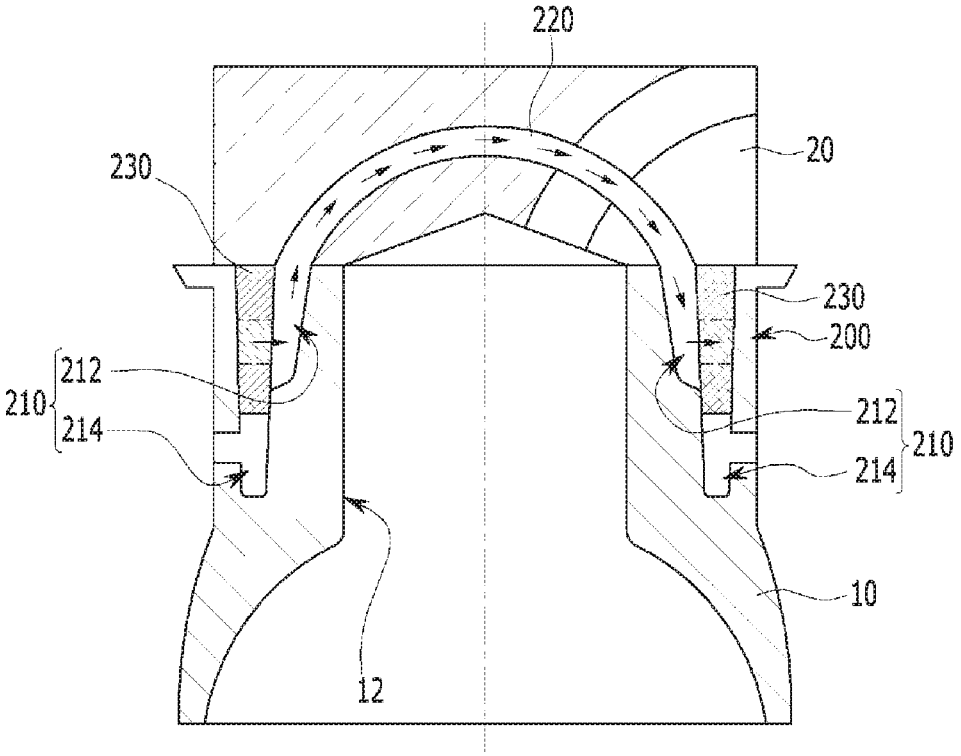
FIG. 3 is a schematic diagram of a water jacket for an engine according to another exemplary embodiment of the present invention.

FIG. 3 is a schematic diagram of a water jacket for an engine according to another exemplary embodiment of the present invention.

Referring to FIG. 3, a water jacket 200 for an engine according to another exemplary embodiment of the present invention is applied to an engine that includes a plurality of combustion chambers 12 formed therein, a cylinder block 10 where a piston 14 is reciprocally movably installed so as to compress or expand the combustion chamber 12, and a cylinder head 20 provided in an upper portion of the cylinder block 10.

Such a water jacket 200 includes a block water jacket 210, a head water jacket 220, and an insert member 230.

The block water jacket 210 is provided in the cylinder block 10, interposing the combustion chambers 12 therebetween. The block water jacket 210 may be provided along a length direction of the cylinder block 10 at a location that is separated by a predetermined distance from the combustion chambers 12 formed in the cylinder block 10.

The head water jacket 220 is provided in the cylinder head 20 corresponding to the combustion chamber 12.

In addition, the insert member 230 is inserted to an upper portion of the block water jacket 210 to partition the block water jacket 210 into an upper block water jacket 212 and a lower block water jacket 214. Further, the insert member 230 enables the upper block water jacket 212 and the head water jacket 220 to be interworked with each other.

Here, the insert member 230 may be installed toward an outer side of the cylinder block 10 at an upper portion of the block water jacket 212.

That is, the upper block water jacket 212 is disposed toward the combustion chamber 12 in the inside of the cylinder block 10.

In addition, the lower block water jacket 214 may be disposed toward an outer side of the cylinder block 10 in the inside of the cylinder block 10 so as to be stepped by the upper block water jacket 212 and the insert member 230.

Accordingly, a coolant introduced into the upper block water jacket 212 may be a cross flow type coolant such that the coolant may pass through the head water jacket 220 while moving close to the combustion chamber 12 along the length direction of the cylinder block 10.

Such a cross flow of the coolant can effectively cool an upper portion of the combustion chamber 12 and the cylinder head 20 having relatively high temperatures compared to the cylinder block 10 as a high-temperature exhaust gas is discharged.

In addition, the coolant introduced into the lower block water jacket 214 can flow along the length direction of the cylinder block 10 at a location distanced toward the outer side of the cylinder block 10 from the combustion chamber 12.

When cooling the cylinder block 10, the water jacket 200 configured as above vertically divides the cylinder block 10 with reference to a height direction of the combustion chamber 12 using the upper block water jacket 212 and the lower water jacket 214 and lets the coolant flow respectively.

In addition, when cooling the cylinder head 20, the water jacket 200 lets the coolant flow as a cross flow type to the head water jacket 220 from the upper block water jacket 212.

Figure 4:
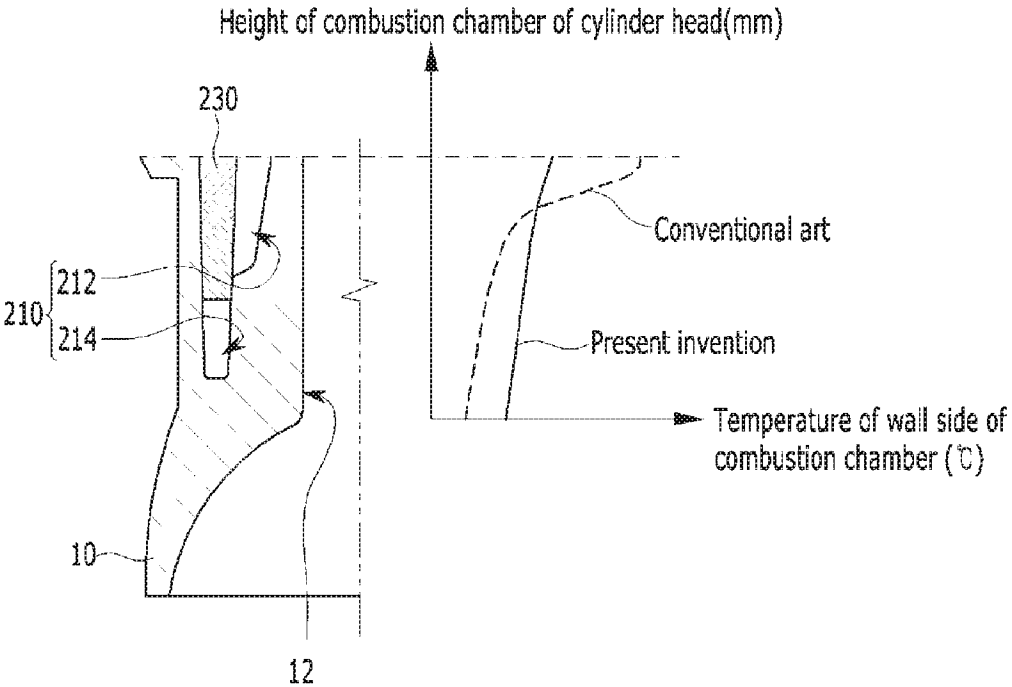
FIG. 4 temperature distribution according to the depth of a combustion chamber of a cylinder block in an engine where the water jacket according to the other exemplary embodiment of the present invention is applied, compared to a conventional art.

FIG. 4 shows temperature distribution according to the height of the combustion chamber of the cylinder block in the engine to which the water jacket according to the exemplary embodiment of the present invention is applied, compared to a conventional art.

Referring to FIG. 4, with reference to an upper surface of the cylinder block 10, an upper portion of the side wall of the combustion chamber 12, having a relatively high temperature is cooled by a coolant flowing to the upper block water jacket 212 provided near the combustion chamber 12.

In addition, a lower portion of the wall side of the combustion chamber 12, having a relatively low temperature compared to the upper portion of the side wall of the combustion chamber 12 is cooled by a coolant flowing to the lower block water jacket 214 partitioned from the upper block water jacket 212 by the insert member 130.

Accordingly, in the cylinder block 10, the block water jacket 210 is partitioned into the upper block water jacket 212 and the lower block water jacket 214 by the insert member 230 such that the coolant individually flows in the cylinder block 10 according to the height of the combustion chamber 12.

Meanwhile, a coolant introduced from the upper block water jacket 212 flows as a cross-flow type coolant in the head water jacket 220 in the cylinder head 20.

That is, the water jacket 200 divides the combustion chamber 12 into an upper portion and a lower portion in the cylinder block 10 so as to effectively cool the cylinder block 10.

Accordingly, as shown in FIG. 4, when the coolant flows to the water jacket 200 according to the present exemplary embodiment, temperature distribution in the side wall of the combustion chamber 12 according to the height of the combustion chamber 12 in the cylinder block 10 is as follows.

First, with reference to an upper surface of the cylinder block 10, a temperature of an upper portion of the side wall of the combustion chamber 10, which is relatively high is decreased compared to a conventional art.

On the contrary, a lower portion of the side wall of the combustion chamber 12, in which the piston 14 reciprocally moves and which has a relatively high temperature is increased in temperature compared to the conventional art.

That is, the upper portion of the combustion chamber 12 is effectively cooled by using the upper water jacket 112 formed adjacent to the combustion chamber 12 such that the temperature can be decreased compared to the conventional art, thereby preventing generation of knocking and minimizing ignition timing control.

On the contrary, the lower portion of the combustion chamber 12 having a relatively low temperature compared to the upper portion of the combustion chamber 12 is increased in temperature compared to the conventional rat such that a temperature of engine oil can be increased, thereby decreasing viscosity of the engine oil. When the viscosity of the engine oil is decreased, a frictional force of the piston 14 reciprocally moving in the inside of the combustion chamber 12 can be minimized, thereby reducing fuel consumption.

Thus, when the water jackets 100 and 200 according to the exemplary embodiments of the present invention are applied to the engine, the upper portion of the cylinder block 10 and the cylinder head 20 are cooled by the coolant flowing as the cross-flow type, and the lower portion of the cylinder block 10 is cooled separately by the cooling flowing thereto such that the cooling effect of the engine can be optimized and durability of the engine can be improved.

In addition, since the cylinder head 20 is cooled to a temperature which is relatively lower than that of the cylinder block 10 such that the amount of blow by gas can be reduced by preventing generation of knocking, and ignition timing control can be minimized, thereby improving engine performance.

Further, since the cylinder block 10 is cooled to a temperature which is relatively higher than that of the cylinder head 20 such that a temperature of engine oil can be increased, thereby decreasing viscosity of the engine oil.

Further, as the viscosity of the engine oil is decreased, a friction loss from the reciprocal movement of the piston 14 such that unnecessary fuel consumption can be prevented, thereby improving entire fuel consumption efficiency.

For convenience in explanation and accurate definition in the appended claims, the terms "upper", "lower", "inner", "outer", "up", "down", "upper", "lower", "upwards", "downwards", "front", "rear", "back", "inside", "outside", "inwardly", "outwardly", "interior", "exterior", "inner", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A water jacket apparatus for an engine including a combustion chamber formed thereinside, a cylinder block where a piston is reciprocally movably installed to compress or expand the combustion chamber, and a cylinder head installed in an upper portion of the cylinder block, comprising:

a block water jacket provided in the cylinder block, interposing the combustion chamber therebetween;

a head water jacket provided in the cylinder head corresponding to the combustion chamber and fluidically connected to the block water jacket; and an insert member inserted into an upper portion of the block water jacket and portioning the block water jacket into an upper block water jacket and a lower block water jacket, for enabling the upper block water jacket to be interworked with the headwater jacket, wherein the upper block water jacket is disposed toward an outer side of the cylinder block in the inside of the cylinder block, wherein the lower block water jacket is disposed toward the combustion chamber in the inside of the cylinder block to be stepped with the upper block water jacket, and wherein the cylinder block is vertically divided in a height direction of the combustion chamber using the upper block water jacket and the lower water jacket which are portioned by the insert member, the insert member allowing the coolant to flow into the upper block water jacket and the lower water jacket, respectively.

2. The water jacket apparatus for the engine of claim 1, wherein the insert member is installed toward the combustion chamber from an upper portion of the block water jacket.

3. The water jacket apparatus for the engine of claim 1, wherein a coolant introduced into the upper block water jacket flows to pass through the head water jacket while moving along a length direction of the cylinder block.

4. The water jacket apparatus for the engine of claim 1, wherein a coolant introduced into the lower block water jacket flows along a length direction of the cylinder block.

5. A water jacket apparatus for an engine including a combustion chamber formed thereinside, a cylinder block where a piston is reciprocally movably installed to compress or expand the combustion chamber, and a cylinder head installed in an upper portion of the cylinder block, comprising:

a block water jacket provided in the cylinder block, interposing the combustion chamber therebetween;

a head water jacket provided in the cylinder head corresponding to the combustion chamber and fluidically connected to the block water jacket; and an insert member inserted into an upper portion of the block water jacket and portioning the block water jacket into an upper block water jacket and a lower block water jacket, for enabling the upper block water jacket to be interworked with the head water jacket, wherein the insert member is installed toward an outer side of the cylinder block at an upper portion of the block water jacket, wherein the upper block water jacket is disposed toward the combustion chamber in the inside of the cylinder block, wherein the upper block water jacket is disposed toward the combustion chamber in the inside of the cylinder block, and wherein the cylinder block is vertically divided in a height direction of the combustion chamber using the upper block water jacket and the lower water jacket which are portioned by the insert member, the insert member allowing the coolant to flow into the upper block water jacket and the lower water jacket, respectively.

* * * * *